US005783344A

United States Patent [19]

Kobayashi et al.

[11] Patent Number: 5,783,344

[45] Date of Patent: Jul. 21, 1998

[54] ELECTROPHOTOGRAPHIC PHOTOSENSITIVE MEMBER

[75] Inventors: Toshio Kobayashi; Kazuki Kubo; Suguru Nagae; Takamitsu Fujimoto, all of Tokyo, Japan

[73] Assignee: Mitsubishi Denki Kabushiki Kaisha, Tokyo, Japan

[21] Appl. No.: 951,558

[22] Filed: Oct. 16, 1997

[30] Foreign Application Priority Data

Mar. 26, 1997 [JP] Japan ..... 9-073709

[51] Int. Cl.[6] ..... G03G 5/14

[52] U.S. Cl. ..... 430/65

[58] Field of Search ..... 430/60, 65

[56] References Cited

U.S. PATENT DOCUMENTS

| | | | |
|---|---|---|---|
| 4,800,144 | 1/1989 | Ueda et al. | 430/65 |
| 5,132,196 | 7/1992 | Hirayama et al. | 430/65 |
| 5,284,727 | 2/1994 | Itakura et al. | 430/60 |
| 5,565,289 | 10/1996 | Yoshihara et al. | 430/65 |

FOREIGN PATENT DOCUMENTS

| | | |
|---|---|---|
| A-58-30757 | 2/1983 | Japan . |
| B-7-27264 | 3/1995 | Japan . |

*Primary Examiner*—Roland Martin

*Attorney, Agent, or Firm*—Sughrue, Mion, Zinn, Macpeak & Seas, PLLC

[57] ABSTRACT

An electrophotographic photosensitive member which comprises an aluminum substrate having an aluminum oxide film at its surface and a photosensitive layer formed on the substrate, which contains a photoconductive material, wherein the aluminum oxide film has a thickness of from 3 to 15 μm, and a resistivity of from $10^9$ to $3\times10^{10}$ Ω/3.14 $cm^2$ when a DC voltage of 20 V is applied, and an impedance of from 1 to 20 MΩ at 100 Hz.

8 Claims, 1 Drawing Sheet

ELECTROPHOTOGRAPHIC PHOTOSENSITIVE MEMBER

BACKGROUND OF THE INVENTION

Field of the Invention

The prevent invention relates to an electrophotographic photosensitive member comprising an aluminum substrate having an aluminum oxide film at its surface and a photosensitive layer formed thereon.

Heretofore, inorganic photosensitive materials such as selenium, cadmium sulfide, zinc oxide and amorphous silicon have been used for electrophotographic photosensitive members. However, these materials have problems of toxicity, inferior moisture resistance as photosensitive materials and high production costs.

In recent years, organic photosensitive members employing organic photoconductive materials have been widely used instead of the inorganic photosensitive members, since the organic photosensitive members have advantages that non-polluting materials can readily be selected and the production costs are low, and from the viewpoint of characteristics, a high photosensitivity and a high printing resistance are obtained.

Most organic photosensitive members placed in practical use are so-called laminated photosensitive members, each having at least a carrier generation layer and a carrier transport layer formed on an aluminum substrate. Such layers are usually laminated on the aluminum substrate by a dip coating method or a ring coating method.

To prevent the generation of a phenomenon such as black spots or background fogging due to local charging deficiency of the photosensitive member, various measures have been made for carrier injection from aluminum, for example, a method wherein a polyamide resin is coated as a blocking layer on an aluminum substrate as disclosed in JP-A-58-30757, and a method wherein an aluminum substrate is treated by anodization to form an alumite layer as disclosed in JP-B-7-27264.

The aluminum material used for such a photosensitive member is usually produced and processed by extrusion molding into a desired shape. However, by the progress of colored documents in business field in recent years, it has been difficult to disregard the influence of uneven density by dimensional inaccuracy in the processing of the aluminum substrate, whereby accuracy in processing has been demanded.

Further, as an organic photosensitive material formed on the substrate, a positive-charging type material which exhibits less ozone generation is favorable from the viewpoint of office environment, and a photosensitive material having phthalocyanine type photoconductive particles dispersed in a binder resin has been studied.

SUMMARY OF THE INVENTION

However, the above conventional resin blocking layer as disclosed in JP-A-58-30757 has a problem that the electrical resistance is remarkably reduced at a high humidity. Further, the above conventional alumite layer as disclosed in JP-B-7-27264 has a low impedance of from 1 to 200 KΩ, whereby such a layer is not adequate as the measure for black spots or background fogging.

Further, phthalocyanine type photosensitive materials as disclosed in JP-A-1-169454 as the positive-charging type photosensitive material which exhibits less ozone generation, has a problem that the printing resistance is not sufficient.

Further, a laminated photosensitive member has a problem that the resolution of recorded images is inadequate.

The present invention has been made to solve the above problems, and it is an object of the present invention to obtain an electrophotographic photosensitive member excellent in printing resistance, by which black spots and background fogging are prevented.

The first electrophotographic photosensitive member of the present invention, comprises an aluminum substrate having an aluminum oxide film at its surface and a photosensitive layer formed on the substrate, which contains a photoconductive material, wherein the aluminum oxide film has a thickness of from 3 to 15 μm, a resistivity of from $10^9$ to $3\times10^{10}$ Ω/3.14 $cm^2$ when a DC voltage of 20 V is applied, and an impedance of from 1 to 20 MΩ at 100 Hz.

The second electrophotographic photosensitive member of the present invention is the one in which the aluminum oxide film of the above first electrophotographic photosensitive member is one subjected to sealing treatment.

The third electrophotographic photosensitive member of the present invention is the one in which the aluminum material of the above first electrophotographic photosensitive member is one obtained by oxidizing the surface of an aluminum substrate of a cylindrical shape with a deviation from circular form, a deviation from cylindrical form and a coaxiality, each being at most 100 μm.

The fourth electrophotographic photosensitive member of the present invention is the one in which the photosensitive layer of the above first electrophotographic photosensitive member is a single layer comprising a metal-free phthalocyanine and a binder resin.

BRIEF DESCRIPTION OF THE DRAWINGS

FIG. 1(*b*) is a cross-sectional view of the aluminum substrate of FIG. 1(*a*).

DETAILED DESCRIPTION OF THE PREFERRED EMBODIMENTS

Figure 1:
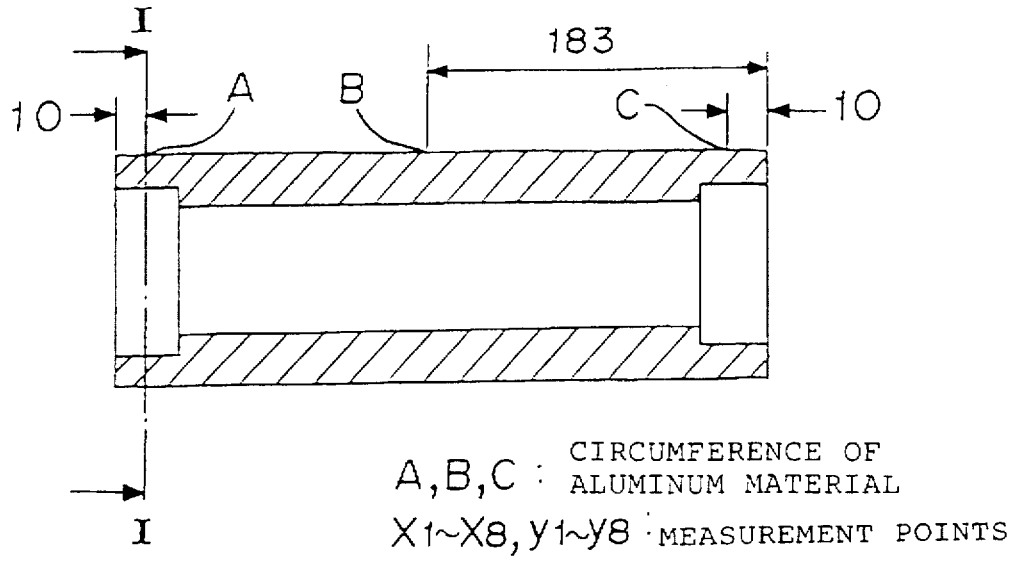
FIG. 1(*a*) is a structural view of an aluminum substrate of the Examples of the present invention.
Figure 1:
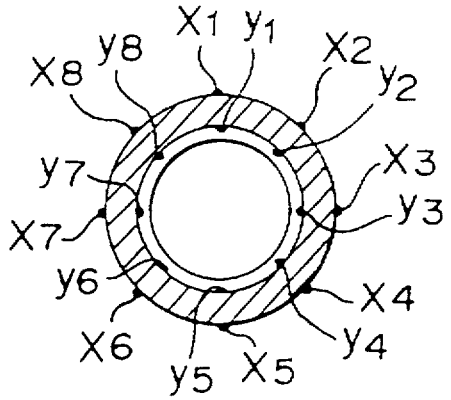

The electrophotographic photosensitive member of the present invention comprises an aluminum substrate and a photosensitive layer formed on the substrate, which contains a photoconductive material. The above aluminum substrate is obtained by oxidizing the surface of an aluminum material by, for example, anodization to form an aluminum oxide film (hereinafter referred to as oxide film).

As the aluminum material, aluminum alloy materials such as a 3000 type alloy of aluminum/manganese and a 6000 series alloy of aluminum/magnesium/silicon, may, for example, be employed.

The oxide film is formed by treating the aluminum material with a conventional method such as anodization treatment in an acid bath of, for example, sulfuric acid, chromic acid or oxalic acid. Among them, the anodization treatment in sulfuric acid provides most preferred results.

In the case of anodization treatment in sulfuric acid, it is preferred to adjust the sulfuric acid concentration within a range of from 100 to 250 g/l, an aluminum ion concentration, from 1 to 15 g/l, a liquid temperature, at about 20° C., and an electrolytic voltage, from 10–20 V. However, the conditions are not limited thereto.

Prior to the anodization treatment, the aluminum substrate is preferably subjected to degreasing treatment with a surfactant or an organic solvent or by electrolysis.

The oxide film has a thickness of from 3 to 15 μm, a resistivity of from $10^9$ to $3\times10^{10}$ Ω/3.14 $cm^2$, preferably from $2\times10^9$ to $2\times10^{10}$ Ω/3.14 $cm^2$, when a DC voltage of 20 V is applied, and an impedance of from 1 to 20 MΩ, preferably from 3 to 17 MΩ, at 100 Hz.

By controlling the oxide film to have a resistivity when a DC voltage of 20 V is applied and an impedance at 100 Hz within the above specific ranges, a high breakdown voltage can be obtained, and it is possible to prevent the formation of black spots and background fogging and to improve the moisture resistance and printing resistance. Accordingly, stable image quality can be obtained even in a continuous operation.

Here, the oxide film having a resistivity of from $10^9$ to $3\times10^{10}$ Ω/3.14 $cm^2$ when a DC voltage of 20 V is applied and an impedance of from 1 to 20 MΩ at 100 Hz, is obtained by controlling the thickness of the oxide film and the degree of sealing. However, if the oxide film is too thick, cracks are likely to form due to the difference in the thermal expansion coefficient between the aluminum substrate and the oxide film during the curing of the photosensitive layer, whereby formation of black spots is caused by the carrier injection from the crack portion. Further, if the oxide film is too thin, the breakdown voltage of the oxide film is extremely reduced, whereby reduction of printing resistance of the photosensitive member is caused. From such viewpoints, the oxide film is preferably formed in a thickness within a range of from 3 to 15 μm, particularly preferably from 4 to 9 μm.

The oxide film is preferably subjected to sealing treatment to adjust the resistivity when a DC voltage is applied and the impedance within the above ranges. The sealing treatment may be made by a conventional method, preferably a sealing treatment method wherein the alumite layer is immersed in an aqueous solution containing nickel acetate as the main component.

In the case where an aqueous nickel acetate solution is used, preferably, the concentration is within a range of from 3 to 20 g/l, pH is from 5 to 6, the treatment temperature is from 55° to 95° C., more preferably from 60° to 90° C., and the treatment time is at least 5 minutes. Then, washing and drying are conducted. If the sealing treatment is inadequate at that time, numerous pores remain at the surface, whereby it is impossible to obtain the above specific resistivity and impedance, and the breakdown voltage of the oxide film tends to be low.

The resistivity of the oxide film formed above may be measured as follows.

Firstly, an aluminum electrode having a diameter of 20 mm is formed on the surface of the oxide film as a main electrode by vapor deposition. Then, the electrode is dried at 150° C. for 2 hours and left to cool for 2 hours in a desiccator, and then the change of electric current value when a direct current voltage of 20 V is applied is measured by a pA meter (tradename: 4140B, manufactured by Yokogawa Hewlett Pakkard K.K.), followed by calculation of the resistivity from the value per minute.

Further, the impedance at 100 Hz was measured by using the same sample as the one used for the measurement of the resistivity with a MULTI-FREQUENCY LCR METER (tradename: 4274A, manufactured by Yokogawa Hewlett Pakkard K.K.).

As the aluminum material, a cylindrical shape body is used. Each of the deviation from circular form, deviation from cylindrical form and coaxiality thereof, is preferably at most 100 μm, particularly preferably at most 50 μm.

When a photosensitive member prepared from the aluminum material with the deviation from circular form, deviation from cylindrical form and coaxiality, each being over 100 μm, is applied to a printer, uneven density is formed in the printed matter, such being undesirable.

The deviation from circular form, deviation from cylindrical form and coaxiality as mentioned above may be obtained by subjecting a cylindrical shape body prepared by mandrel extrusion or port-hole extrusion to processing such as a cutting and grinding treatment, a blast treatment or a honing treatment.

When the photosensitive layer is a single layer comprising a metal-free phthalocyanine and a binder resin, the resolution and the image quality are high, the printing resistance is excellent and the generation of ozone can be reduced.

As the photosensitive layer, in addition to the above, various organic photoconductive layers may be used. It is preferred to use a single layer type photosensitive layer having one or a mixture of two or more of phthalocyanines such as metal-free phthalocyanine, titanyl phthalocyanine or copper phthalocyanine as a carrier generating material, dispersed in a binder resin. Among them, a single layer type photosensitive layer obtained by using metal-free phthalocyanine (tradename: Fastogen Blue 8120-BS, manufactured by Dainippon Ink & Chemicals, Inc.) is particularly preferred in the stability of electrophotographic properties.

As the binder resin, a polyester resin, a polycarbonate resin, a polyvinyl butyral resin, an epoxy resin and a polystyrene resin may, for example, be used alone or in combination. To these binder resins, a curing agent of modified melamine resin or an epoxy resin may be added.

Further, to the photosensitive layer of the present invention, a silicone type compound, an ozone-degradable compound and an antioxidant may, for example, be added for the purpose of improving the printing resistance, as the case requires.

In the electrophotographic photosensitive member of the present invention, a protective layer of, for example, an acrylic resin, a silicone resin, an epoxy resin, an isocyanate resin or a polyester resin may be formed for the purpose of protecting the member from mechanical friction in the development, transfer and cleaning steps.

Further, to improve the photosensitivity of the electrophotographic photosensitive member, an electron receiving substance such as tetracyanoethylene or tetracyanoquinodimethane may be added to the photosensitive layer.

EXAMPLE 1

An aluminum material of a cylindrical shape having its surface mirror finished, with a diameter of 96 mm, a length of 366 mm, a thickness of 1.5 mm and a thickness of socket joint portion of 1.0 mm, which has a deviation from circular form, a deviation from cylindrical form and a coaxiality, each being at most 100 μm, was used.

FIG. 1 is a view illustrating the structure of the aluminum material used for an electrophotographic photosensitive member of the Examples of the present invention and explaining the methods for measuring the deviation from circular form, deviation from cylindrical form and coaxiality. FIG. 1(*a*) is a transverse cross-sectional view of the cylindrical aluminum material, and FIG. 1(*b*) is a cross-sectional view of the aluminum material of FIG. 1(*a*) at the I—I line. In FIG. 1(*a*), the units of the numerical values are mm, and A, B and C indicate the circumferences of the outer surface of the cylinder at which the deviation from circular form and the deviation from cylindrical form were measured. The coaxiality was determined as follows. A reference axis was fixed based on measurement points $y_1$ to $y_8$ located along the inner surface of the cylinder at the circumferences A and C. Measurement points $x_1$ to $x_8$ located along the circumferences A, B and C were measured to determine the center thereof. The coaxiality was determined as a deviation of the center from the reference axis.

In this Example, the circumference B was located at the center portion of the aluminum substrate, and each of the circumferences A and C was located at the point 10 mm inside from each of the both ends of the cylinder, as indicated in FIG. 1(*a*).

The coaxiality was measured at the above measurement points in accordance with JIS B0621, at a 3-dimensional measurement pressure of 0.1N, under the conditions of 20°±0.5° C., 50±10% RH and the degree of cleanness at the class of 10,000. Further, the deviation from circular form and the deviation from cylindrical form were measured in accordance with JIS B0621. The deviation from circular form, the deviation from cylindrical form and the coaxiality are shown in Table 1.

The deviation from circular form and the deviation from cylindrical form were measured by an apparatus for measuring the deviation from circular form (tradename: Loncom 52B-510, manufactured by Tokyo Seimitsu K.K.) and the coaxiality was measured by a super precise 3-dimensional measuring apparatus (tradename: PMM654, Leitz).

TABLE 1

| Aluminum material (Aluminum substrate a) | | |
|---|---|---|
| Deviation from circular form | A (μm) | 29.2 |
| | B (μm) | 10.3 |
| | C (μm) | 35.3 |
| Deviation from cylindrical form | | 35.3 |
| Coaxiality | A (μm) | 20.6 |
| | B (μm) | 18.1 |
| | C (μm) | 22.7 |

The above aluminum material was degreased and washed at 55° C. for 10 minutes with the one having a degreasing agent (tradename: DK Beclear CW-4130, manufactured by Daiichi Kogyo Pharmacy K.K.) diluted with water to a concentration of 15%, and washed with water and then subjected to etching, followed by washing with water. Then, the above degreased and washed aluminum material was subjected to anodization at a DC voltage of 20 V for 15 minutes with a sulfuric acid solution of 160 g/l as an electrolytic solution to form an alumite layer as an anodized film having an average film thickness of 7 μm at the surface of the aluminum material.

Then, after washing, the aluminum substrate was immersed in an aqueous solution of a sealing agent comprising nickel acetate as the main component in an amount of 8 g/l at 72° C. for 15 minutes for sealing treatment, and washed with pure water, followed by drying, to prepare an aluminum substrate to be used for the Example of the present invention. The thus obtained aluminum substrate was used as an aluminum substrate a.

The resistivity of the above oxide film when a DC voltage of 20 V was applied, was $3\times10^9$ Ω/3.14 $cm^2$, and the impedance was 10 MΩ at 100 Hz.

Further, continuity test of the oxide film was conducted with a pinhole tester (tradename: Pinhole Detector TYPE TRD, manufactured by Sanko K.K.). The measured potential was 1.3 kV.

On the other hand, 9 g of a metal-free phthalocyanine (tradename: Fastogen Blue 8120-BS, Dainippon Ink & Chemicals, Inc.), 9 g of a polyester resin (tradename: Almatex P-645, Mitsui Toatsu Chemical Co.), a polyester resin (tradename: Viron RV-200, a toluene/methyl ethyl ketone (MEK) solution having a solid content of 30%, manufactured by Toyo Boseki K.K.), 8 g of a butylated melamine resin (tradename: Yuban 20HS, manufactured by Mitsui Toatsu Chemical Co.), 130 g of toluene, 30 g of MEK and 80 g of glass beads having a diameter of 1 mm, were mixed and subjected to dispersion treatment by grinding by a paint shaker for 2 hours.

The above aluminum substrate a was immersed in this dispersion for coating, and then heated at 150° C. for 3 hours for curing to form a photosensitive layer of about 20 μm, to produce the electrophotographic photosensitive member of this Example of the present invention. This electrophotographic photosensitive member is referred to as photosensitive member A.

EXAMPLES 2 to 7

Aluminum substrates b to g were prepared in the same manner as in Example 1 except that the thickness of the oxide film, the sealing treatment conditions of the oxide film, and the deviation from circular form, deviation from cylindrical form and coaxiality of the aluminum material, were changed as indicated in Table 2.

The resistivity, the impedance, and the potential measured by continuity test of the oxide film, were measured in the same manner as in Example 1, and the results are shown in Table 2.

TABLE 2

| Examples | | 2 | 3 | 4 | 5 | 6 | 7 |
|---|---|---|---|---|---|---|---|
| Aluminum substrate No. | | b | c | d | e | f | g |
| Thickness of alumite layer (μm) | | 3.5 | 6.0 | 7.5 | 9.0 | 12 | 7.2 |
| Sealing conditions | Concentration of sealing liquid (g/l) | 18 | 17 | 10 | 13 | 10 | 8 |
| | Treatment temperature (°C.) | 70 | 75 | 77 | 67 | 65 | 72 |
| | Treatment time (min.) | 23 | 20 | 21 | 22 | 19 | 15 |
| Resistivity (Ω/3.14 $cm^2$) | | $1.5\times10^9$ | $4.5\times10^9$ | $4.2\times10^9$ | $5.3\times10^9$ | $6.2\times10^9$ | $4.2\times10^9$ |
| Impedance (MΩ) | | 2.5 | 9.8 | 9.3 | 11.8 | 13.7 | 10.7 |
| Potential measured by continuity test (kV) | | 1.1 | 1.3 | 1.4 | 1.5 | 1.6 | 1.4 |
| Deviation | A (μm) | 12.6 | 41.8 | 33.6 | 52.2 | 23.5 | 215 |

TABLE 2-continued

| Examples | | 2 | 3 | 4 | 5 | 6 | 7 |
|---|---|---|---|---|---|---|---|
| from circular form | B (μm) | 4.3 | 8.8 | 10.3 | 25.4 | 9.6 | 112 |
| | C (μm) | 26.6 | 11.9 | 23.3 | 34.6 | 22.4 | 194 |
| Deviation from cylindrical form (μm) | | 26.6 | 41.8 | 33.6 | 34.6 | 23.5 | 215 |
| Coaxiality | A (μm) | 25.7 | 23.2 | 22.5 | 28.6 | 22.2 | 192 |
| | B (μm) | 19.4 | 9.8 | 13.6 | 11.6 | 10.4 | 114 |
| | C (μm) | 22.2 | 25.6 | 23.7 | 27.5 | 21.1 | 211 |

Then, using the above aluminum substrates b to g, photosensitive members B to G, were prepared in the same manner as in Example 1.

COMPARATIVE EXAMPLES 1 to 4

Aluminum substrates h to k were prepared in the same manner as in Example 1 except that the thickness of the oxide film of the aluminum material, the sealing treatment conditions of the oxide film, and the deviation from circular form, deviation from cylindrical form and coaxiality of the aluminum material, were changed as indicated in Table 3.

The resistivity, the impedance and the potential measured by continuity test of the oxide film were measured in the same manner as in Example 1, and the results are shown in Table 3.

TABLE 3

| Comparative Examples | | 1 | 2 | 3 | 4 |
|---|---|---|---|---|---|
| Aluminum substrate No. | | h | i | j | k |
| Thickness of alumite layer (μm) | | 7.5 | 7.2 | 18.0 | 2.8 |
| Sealing conditions | Concentration of sealing liquid (g/l) | No sealing treatment | 10 | 30 | 13 |
| | Treatment temperature (°C.) | | 55 | 95 | 60 |
| | Treatment time (min.) | | 10 | 30 | 12 |
| Resistivity (Ω/3.14 cm$^2$) | | $5.8 \times 10^6$ | $5.0 \times 10^7$ | $5.7 \times 10^{10}$ | $5.3 \times 10^6$ |
| Impedance (MΩ) | | 0.30 | 0.82 | 16.3 | 0.27 |
| Potential measured by continuity test (kV) | | 0.4 | 0.5 | 1.8 | <0.3 |

TABLE 3-continued

| Comparative Examples | | 1 | 2 | 3 | 4 |
|---|---|---|---|---|---|
| Deviation from circular form | A (μm) | 15.9 | 31.8 | 43.6 | 32.5 |
| | B (μm) | 9.3 | 18.8 | 20.7 | 20.1 |
| | C (μm) | 26.2 | 31.9 | 33.3 | 30.2 |
| Deviation from cylindrical form (μm) | | 26.2 | 31.9 | 43.6 | 32.5 |
| Coaxiality | A (μm) | 22.7 | 30.2 | 32.2 | 29.2 |
| | B (μm) | 13.4 | 13.8 | 11.9 | 13.7 |
| | C (μm) | 22.6 | 22.6 | 27.3 | 25.9 |

Then, using the above aluminum substrates h to k, photosensitive members H to K were prepared in the same manner as in Example 1. In the photosensitive member J, cracks formed in the oxide film after heating for curing.

The photosensitive members A to K prepared as above were fitted in a laser printer with a resolution of 600 dpi, and evaluations were conducted with respect to defects of black spots in white solid images under various environmental conditions, uneven density in black solid images at 25° C. and 55% RH, and printing resistance at 35° C. and 85% RH. The results are shown in Table 4. In the table, "○" indicates no defects of black spots, "Δ" indicates partial defects of black spots, and "×" indicates defects of black spots in entire area.

TABLE 4

| | | Photosensitive member | Presence or absence of defects of black spots | | | Uneven density | Printing resistance |
|---|---|---|---|---|---|---|---|
| | | | 10° C. 30% RH | 25° C. 55% RH | 35° C. 80% RH | 25° C. 55% RH | (number of cycle) |
| Example | 1 | A | ○ | ○ | ○ | ○ | >30,000 |
| | 2 | B | ○ | ○ | ○ | ○ | >30,000 |
| | 3 | C | ○ | ○ | ○ | ○ | >30,000 |
| | 4 | D | ○ | ○ | ○ | ○ | >30,000 |
| | 5 | E | ○ | ○ | ○ | ○ | >30,000 |
| | 6 | F | ○ | ○ | ○ | ○ | >30,000 |
| | 7 | G | ○ | ○ | ○ | X | >30,000 |
| Comparative Example | 1 | H | Δ | Δ | X | ○ | 1,500 |
| | 2 | I | ○ | Δ | X | ○ | 2,000 |
| | 3 | J | Evaluation was impossible by the formation of cracks on the oxide film | | | | |
| | 4 | K | Δ | X | X | ○ | 900 |

From the above results, the photosensitive members A to G obtained in Examples 1 to 7 are excellent in the printing resistance and show no defects of black spots even at a high humidity, whereby these are excellent in the moisture resistance, and the photosensitive members A to F obtained in Examples 1 to 6 show no uneven density.

On the other hand, for example, when the oxide film is too thick or the resistivity departs from the predetermined range (Photosensitive members H, I, J and K), the formation of defects of black spots is seen and the printing resistance and moisture resistance are inferior.

The first electrophotographic photosensitive member of the present invention comprises an aluminum substrate having an aluminum oxide film at its surface and a photosensitive layer formed on the substrate, which contains a photoconductive material, wherein the aluminum oxide film has a thickness of from 3 to 15 μm, a resistivity of from $10^9$ to $3\times10^{10}$ Ω/3.14 $cm^2$ when a DC voltage of 20 V is applied, and an impedance of from 1 to 20 MΩ at 100 Hz, and shows effects such that black spots and background fogging are prevented and moisture resistance and printing resistance are improved.

The second electrophotographic photosensitive member of the present invention is the one wherein the aluminum oxide film of the first electrophotographic photosensitive member is one subjected to sealing treatment, and shows an effect such that the above specific resistivity and impedance can readily be obtained.

The third photographic photosensitive member of the present invention is the one wherein the aluminum substrate of the above first or second electrophotographic photosensitive member is one obtained by oxidizing the surface of an aluminum material of a cylindrical shape with a deviation from circular form, a deviation from cylindrical form and a coaxiality, each being at most 100 μm, and shows an effect such that the formation of uneven density of printed matter can be prevented.

The fourth electrophotographic photosensitive member of the present invention is the one wherein the photosensitive layer of the first, second or third electrophotographic photosensitive member is a single layer comprising a metal-free phthalocyanine and a binder resin, and shows effects such that image quality is high, printing resistance is excellent, and generation of ozone can be reduced.

What is claimed is:

1. An electrophotographic photosensitive member which comprises an aluminum substrate having an aluminum oxide film at its surface and a photosensitive layer formed on the substrate, which contains a photoconductive material, wherein the aluminum oxide film has a thickness of from 3 to 15 μm, a resistivity of from $10^9$ to $3\times10^{10}$ Ω/3.14 $cm^2$ when a DC voltage of 20 V is applied, and an impedance of from 1 to 20 MΩ at 100 Hz.

2. The electrophotographic photosensitive member according to claim 1, wherein the aluminum oxide film is one subjected to sealing treatment.

3. The electrophotographic photosensitive member according to claim 1, wherein the aluminum oxide film has a thickness of from 4 to 9 μm.

4. The electrophotographic photosensitive member according to claim 1, wherein the aluminum substrate is one obtained by oxidizing the surface of an aluminum material of a cylindrical shape with a deviation from circular form, a deviation from cylindrical form and a coaxiality, each being at most 100 μm.

5. The electrophotographic photosensitive member according to claim 4, wherein each of the deviation from circular form, the deviation from cylindrical form and the coaxiality, is at most 50 μm.

6. The electrophotographic photosensitive member according to claim 1, wherein the photosensitive layer is a single layer comprising a metal-free phthalocyanine and a binder resin.

7. The electrophotographic photosensitive member according to claim 1, wherein the resistivity of the aluminum oxide film is from $2\times10^9$ to $2\times10^{10}$ Ω/3.14 $cm^2$ when a DC voltage of 20 V is applied.

8. The electrophotographic photosensitive member according to claim 1, wherein the impedance of the aluminum oxide film is from 3 to 17 MΩ at 100 Hz.

* * * * *

UNITED STATES PATENT AND TRADEMARK OFFICE

CERTIFICATE OF CORRECTION

PATENT NO. : 5,783,344
DATED : July 21, 1998
INVENTOR(S) : TOSHIO KOBAYASHI, KAZUKI KUBO, SUGURU NAGAE, and TAKAMITSU FUJIMOTO It is certified that error appears in the above-identified patent and that said Letters Patent is hereby corrected as shown below:

In Claim 1, line 2, delete "which comprises" and insert --comprising:--;
line 3, delete "at its surface" and insert --formed on a surface of the aluminum substrate;--;
line 3, after "layer" insert --containing photoconductive material--;
line 4, after "the" insert --aluminum--;
line 4, delete "which contains a photoconductive material,".

In Claim 2, line 3, delete "is one" and insert --has been-.

In Claim 3, line 3, delete "from".

In Claim 4, line 3, delete "one obtained" and insert --formed--;
line 4, delete "of" and insert --having--;
line 4, delete "with a deviation from" and insert --which does not deviate from--;
line 5, delete "a deviation from" and "a" (second occurence);
line 6, delete "each being at most 100 $\mu$m" and insert --by more than 100 $\mu$m each--.

UNITED STATES PATENT AND TRADEMARK OFFICE

CERTIFICATE OF CORRECTION

PATENT NO. : 5,783,344

DATED : July 21, 1998

INVENTOR(S) : TOSHIO KOBAYASHI, KAZUKI KUBO, SUGURU NAGAE, and TAKAMITSU FUJIMOTO It is certified that error appears in the above-identified patent and that said Letters Patent is hereby corrected as shown below:

In Claim 5, lines 2-5, delete "each of the deviation from circular from, the deviation from cylindrical form and the coaxiality, is at most 50 $\mu$m" and insert --the aluminum material having the cylindrical shape does not deviate from circular form, cylindrical form or coaxiality by more than 50 $\mu$m each--.

Signed and Sealed this

Tenth Day of November 1998

Bruce Lehman

*Attest:*

BRUCE LEHMAN

*Attesting Officer*

*Commissioner of Patents and Trademarks*